United States Patent [19]

Lippmann et al.

[11] Patent Number: 4,859,912

[45] Date of Patent: Aug. 22, 1989

[54] STABLE BRIGHTNESS VACUUM FLUORESCENT DISPLAY

[75] Inventors: Raymond Lippmann, Ann Arbor; James E. Nelson, Union Lake, both of Mich.

[73] Assignee: General Motors Corporation, Detroit, Mich.

[21] Appl. No.: 769,395

[22] Filed: Aug. 26, 1985

[51] Int. Cl.[4] ..... G09G 3/10

[52] U.S. Cl. ..... 315/169.3; 315/169.1

[58] Field of Search ..... 250/578; 313/582, 341; 315/169.1, 169.4, 169.3

[56] References Cited

U.S. PATENT DOCUMENTS

| | | | |
|---|---|---|---|
| 4,217,578 | 8/1980 | Inami | 340/754 |
| 4,241,294 | 12/1980 | Fisler | 315/291 |
| 4,358,713 | 11/1982 | Senoo et al. | 315/291 |
| 4,401,982 | 8/1983 | Miyazaki | 340/758 |
| 4,459,514 | 7/1984 | Morimoto et al. | 315/169.1 |
| 4,488,089 | 12/1984 | Shota et al. | 315/106 |
| 4,495,445 | 1/1985 | Turney | 315/169.1 |

*Primary Examiner*—David K. Moore

*Attorney, Agent, or Firm*—Warren D. Hill

[57] ABSTRACT

To avoid non uniform brightness or flickering of a vacuum fluorescent display especially at low brightness levels anodes energizing pulses sent to each end of the display are coordinated with the AC filament current so that successive pulses or group of pulses are initiated at opposite phases of the filament current at sufficiently high rates to time average the light variations of a critical flicker fusion period to obtain uniform perceived display brightness.

6 Claims, 2 Drawing Sheets

STABLE BRIGHTNESS VACUUM FLUORESCENT DISPLAY

FIELD OF THE INVENTION

This invention relates to brightness controls for vacuum fluorescent displays, and particularly to such controls for obtaining very low light levels without perceptible flicker or light variations across the display.

BACKGROUND OF THE INVENTION

A typical vacuum fluorescent display device comprises a transparent evacuated envelope containing a plurality of anodes arranged in a pattern of desired light emission, each anode being coated with a fluorescent layer for emitting light when excited, a heated filament serving as a source of electrons, and control grids located between the filament and the anodes for determining which anodes can be excited by the electrons. When the anodes and the control grids are at a high voltage and the filament is at a lower voltage the electrons can excite the fluorescent layer on the anodes to cause light emission from the anodes. The brightness of the emitted light depends very strongly on the voltage between the filament and anode. When dc heating current is applied to the filament, a voltage drop occurs along the filament so that at one end of the filament the anode to filament voltage is somewhat less than at the other end so that a difference of brightness occurs across the display. The use of alternating current in the filament overcomes this brightness difference provided the frequency is high enough that no perceptible flicker occurs. As is well known, the eye responds relatively slowly to light impulses so that repetitive images appear as one and brightness variations in the images are averaged over time, provided that the images occur at a sufficiently rapid rate, called the critical flicker fusion frequency. When brightness variations are time averaged over a critical fusion period the differences are imperceptible. The critical frequency is regarded to be in the range of 16 to 30 Hz in the case of a stationary display; however, where the display may rapidly move relative to the observer, such as may occur in a moving automotive vehicle, a stroboscopic effect occurs so that a higher rate, say 100 to 130 Hz is required to achieve the appearance of a continuous light source. The application of AC driving potential to a filament can cause acoustic affects or singing due to the filament vibration. Thus the frequency of the filament current must be high enough to minimize the the acoustic affects. This requires that the frequency should be above 20 kHz. On the other hand, the frequency should be low enough to minimize radio frequency interference and inductive problems.

A number of mechanisms are available for controlling the brightness of a display. A preferred method is to use a variable duty cycle for anode energization so that maximum brightness is obtained when an anode is illuminated 100% of the time or, in the case of a multiplex system, when it is illuminated for 100% of its allotted time slot. In such cases when the filament current frequency is sufficiently high many filament cycles occur during each ON cycle of the anode and the non-uniformity of brightness discussed above does not present any problem. It is often required, however, that a dimming ratio in excess of 200 is required in order to obtain satisfactory extremes of brightness. In the case of very low brightness when the duty cycle is, for example, one percent or less of the allotted anode ON time the actual ON time may be but a fraction of a filament current cycle. In that circumstance, the display non-uniformity or display flicker is a significant problem. Flicker can occur because at certain duty cycles many successive anode ON times can occur for a given anode when the filament voltage is at a low state and then later on a similar succession of anode ON times can occur when the filament voltage is at a high state so that time averaging of the anode brightness over its entire brightness fluctuation range does not occur within the critical flicker fusion period.

U.S. Pat. No. 4,495,445 reveals a brightness control for vacuum fluorescent display. It recognizes the brightness non-uniformity problems, especially at low brightness levels. The control circuit operates at a filament frequency of 60 Hz and the anode ON time is, at most, one period of the filament current. With that restriction, a large dimming ratio is not possible except at low frequencies. Display brightness is controlled by varying the duty cycle of the anode, utilizing a duty cycle symmetrical about the zero crossing of the filament voltage, and having ON times close to the zero crossing. The non-uniformity at low brightness is minimized since the potential variation along the length of the filament is minimized in the vicinity of the zero crossing. That control circuit is particularly designed for operation on sine wave control signals and it does not teach a control method useful with a high frequency digital logic control or using square wave control pulses. Moreover, such a control circuit is not amenable to both high frequency operation and high dimming ratios.

SUMMARY OF THE INVENTION

An object of the invention is to provide a vacuum fluorescent display control circuit operable at high frequencies and at a high dimming ratio which exhibits uniform display brightness at low brightness levels.

The invention is carried out by providing a vacuum fluorescent display control circuit comprising a supply circuit for supplying alternating current to the filament, an enabling circuit for aperiodically generating control pulses for illuminating selected anodes, a pulse width modulation circuit for controlling the duty cycle of the control pulses for controlling display brightness, and a coordinating circuit for initiating successive control pulses or groups of control pulses at opposite phases of the filament current at sufficiently high rates to obtain a uniform perceived display brightness.

BRIEF DESCRIPTION OF THE DRAWINGS

The above and other advantages of the invention will become more apparent from the following description taken in conjunction with the accompanying drawings wherein like reference numerals refer to like parts and wherein.

DESCRIPTION OF THE PREFERRED EMBODIMENT

Figure 1:
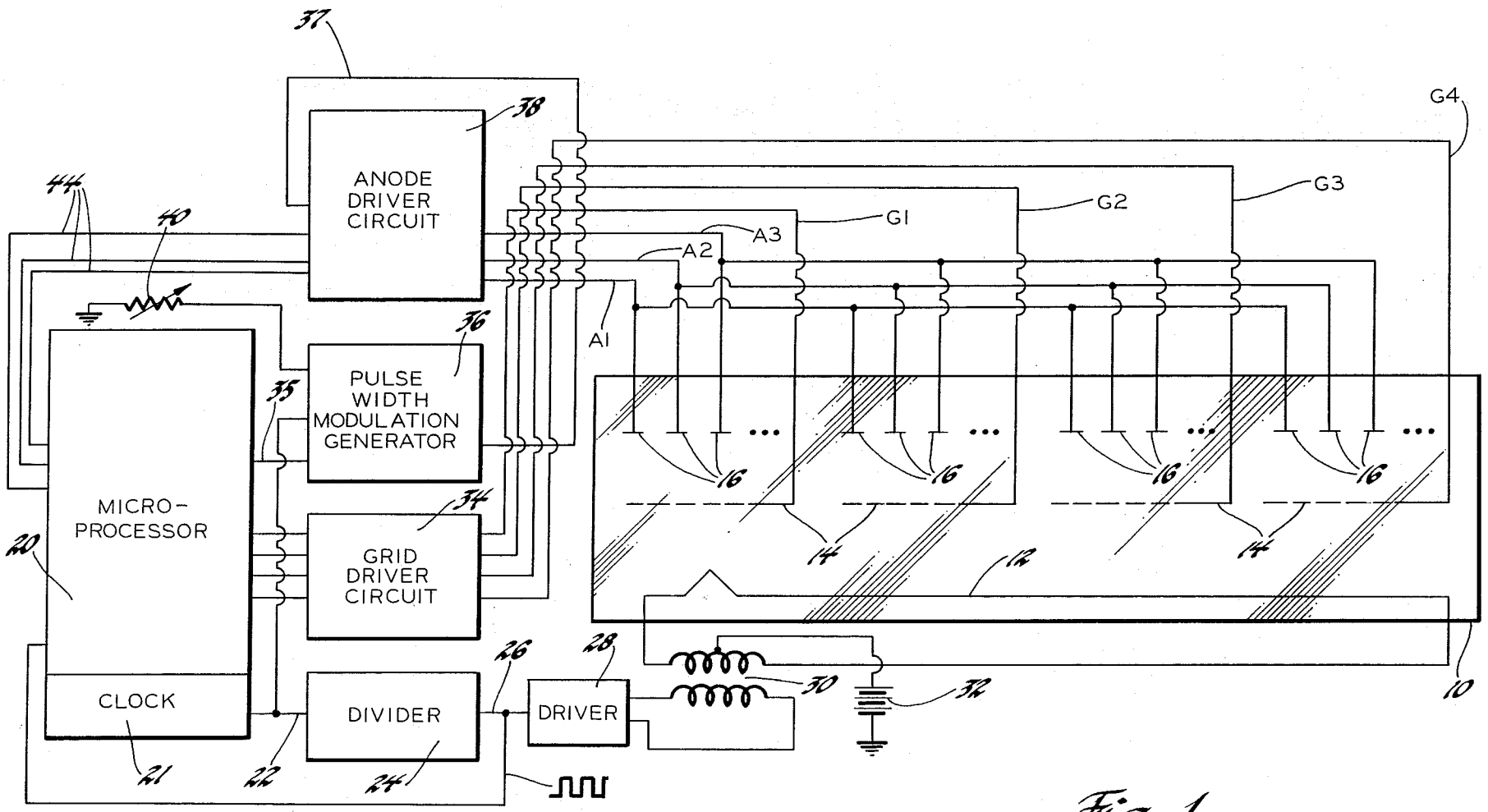
FIG. 1 is a block diagram of a vacuum fluorescent display control circuit according to the invention.

FIG. 1 shows a vacuum fluorescent display tube comprising a transparent evacuated envelope 10 containing a filament 12, a plurality of grids 14, and a group of anodes 16 associated with each grid. This is a well known display arrangement suitable for multiplexing the display so that a set of anodes can be turned on only when the associated grid 14 is turned on, and the grids are successively energized thereby allowing sequential operation of the groups of anodes. In order to achieve all of the foregoing objects and advantages convenient parameters for operating the display comprise a multiplex slot time of 250 μm sec to minimize stroboscopic effects, a dimming ratio of 1 to 256 to allow a wide control of display dimming, and a typical filament frequency of 40 kHz.

Figure 2:
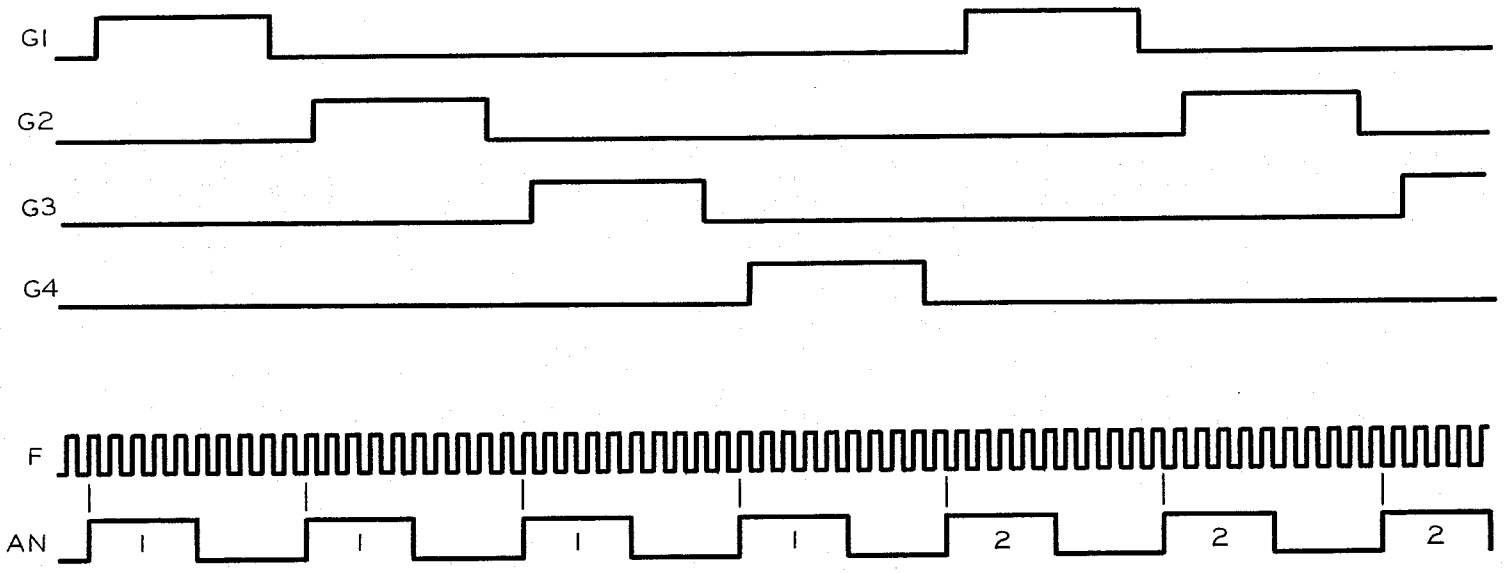
FIGS. 2 and 3 are sets of wave forms illustrating the operation of the circuit of FIG. 1.

A microprocessor 20 includes a clock section 21 which produces a 400 kHz master clock signal which is output on the clock line 22, a digital divider 24 set to divide the clock signal by 10 to produce on line 26 a 40 kHz square wave signal and a power driver 28 for driving a filament transformer 30 at 40 kHz. The filament may be operated on square wave current or sine wave current. The transformer secondary is coupled to the filament 12 and has a center tap connected to ground through an optional bias supply 32 which establishes the base potential of the filament 12. The microprocessor has an input coupled to the line 26 thereby obtaining the 40 kHz filament control signal for synchronization purposes. The filament control signal F is shown in FIG. 2. The microprocessor has grid output terminals which are successively energized to trigger grid output drivers 34 to apply grid voltages to the grids 14 over lines G1 through G4, in turn. The grid voltages are illustrated in FIG. 2 as G1 through G4. The sequence of four grid signals is repeated each millisecond. The microprocessor also has a synch output on line 35 derived from the filament feedback signal F which triggers a pulse width modulation generator 36. An output signal AN of generator 36 on line 37 is coupled to the anode driver circuit 38 to enable the outputs to selected anodes 16. The signal AN is shown in FIG. 2. The modulation generator 36 also has inputs from the clock line 22 as well as from a manually controlled variable resistor 40 which determines the desired display brightness. The pulse on line 37 then is terminated at a time consistent with the desired brightness. Anode control outputs from the microprocessor are coupled by lines 44 to the anode drivers 38 to selectively enable the individual drivers to selectively energize the appropriate anode lines A1, A2, A3 etc. It is not essential to use a microprocessor since other digital logic circuits can perform the same tasks.

FIG. 2 illustrates the operation of the device in terms of the relative phases of the control signals. The anode signals AN are shown as 50% duty cycle signals corresponding to medium display brightness. The duty cycle will vary according to the brightness control. The first AN pulse which occurs during the grid G1 ON time is synchronized to a rising edge of the filament control signal F. The AN signal initiation time does not have to be simultaneous with the rising edge of the filament but can be a fixed delay time after the filament signal rising edge. The same is true of the next three anode pulses which occur during the grid ON times G2 through G4. Those four anode pulses are each identified by the numeral 1. Thus during the four grid ON periods each enabled anode of the display will be illuminated for a period equal to the period of the AN signal. If that signal is very short, corresponding to low display brightness, then the anodes at one edge of the filament will be substantially brighter than those at the other end of the filament. During the next series of four grid signals anode pulses of the same width (identified by the numeral 2) will be produced, however, each pulse will be initiated at a time synchronized to a falling edge of the filament signal F or, as in the case of the first series of signals, a fixed delay time after a falling edge of the signal F. During this series of pulses the anodes which were formerly brighter will now be dimmer and vice versa, so that time averaging over the two successive groups of pulses will make the display brightness appear to the human eye to be stable and uniform.

Figure 3:
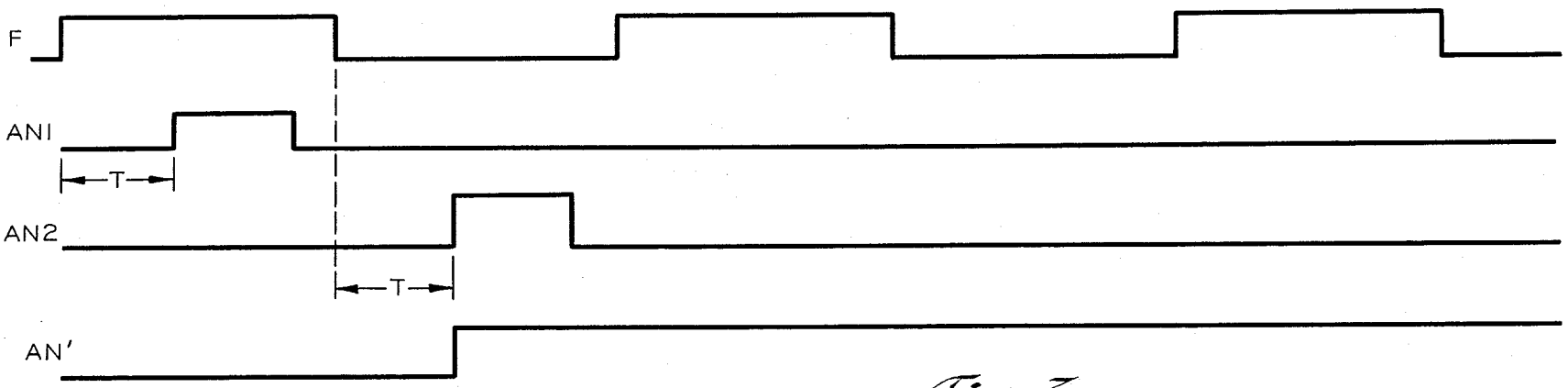

The control signal relationships are shown on an expanded scale in FIG. 3. There anode signals AN1 are initiated a fixed delay time T after the rise time of filament control signal F and the anode control signal AN2 is initiated the same fixed delay time T after the falling edge of the filament signal F. The signals AN1 and AN2 do not occur within the same grid enabling pulse but are shown here on a compressed time scale to illustrate the phase difference. The two anode signals are 180° of the filament signal out of phase to ensure offsetting brightness variations. The signals AN1 and AN2 have ON times less than the filament signal period to illustrate the condition of very low brightness. A signal AN′ is shown which corresponds to larger duty cycles like that of signal AN in FIG. 2.

The microprocessor 20 must sense the filament control signal F and for each multiplex slot initiate a synch pulse synchronized to a rising edge of signal F. Then an equal number of synch pulses are synchronized to the falling edge of the filament control signal F, and so on. In the event the display is not multiplexed, then successive synch signals may be alternately keyed to the rising and falling edges of the filament control signal. Alternatively, they may be grouped as in the case of the multiplex system so long as the operation is fast enough to result in perceived uniform brightness.

In the system described herein the brightness is controlled by varying the duty cycle of the anode signals, however, the same can be accomplished by varying the duty cycle of the grid signals G1 through G4 or by varying the duty cycle of the filament bias. Whenever the filament has a high bias voltage, say equal to the grid and anode voltage, the display will be off, but when it is shifted to a low voltage then the display is turned on provided anode and grid signals are on. Accordingly, any of the three electrodes, filament, anode, or grid can be used as the control element of the vacuum fluorescent tube and the system of FIG. 1, with small modifications, will apply to provide uniform display brightness at low brightness levels irrespective of which element is used is the control element.

It will thus be seen that according to this invention a digital logic controlled vacuum fluorescent display can achieve brightness which is uniform across the face of the display as well as uniform with time even when dimmed to very low levels.

The embodiments of the invention in which an exclusive property or privilege is claimed are defined as follows:

1. A brightness control circuit for a vacuum fluorescent display having control electrode means selected from anode, grid, and filament electrodes, means for supplying alternating current to the filament electrodes whereby the filament-to-anode voltage and the emitted light intensity varies with time and varies across the display, enabling means for aperiodically generating control pulses for enabling display illumination, pulse width modulation means for controlling the duty cycle of the control pulses thereby controlling display brightness, and means for coordinating the enabling means with the filament current to initiate successive control pulses or groups of control pulses at opposite phases of the filament current at sufficiently high rates to obtain uniform perceived display brightness.

2. A brightness control circuit for a vacuum fluorescent display having control electrode means selected from anode, grid, and filament electrodes, means for supplying alternating current to the filament electrodes whereby the filament-to-anode voltage and the emitted light intensity varies with time and varies across the display and for supplying a square wave feedback signal corresponding to the filament current, enabling means for aperiodically generating control pulses for energizing the control electrode means to enable display illumination, pulse width modulation means for controlling the duty cycle of the control pulses thereby controlling display brightness, and microprocessor means for coordinating the enabling means with the filament current by initiating successive control pulses or groups of control pulses alternately synchronized to rising and falling edges of the feedback signal at sufficiently high rates to obtain uniform perceived display brightness.

3. A brightness control circuit for a vacuum fluorescent display having control electrode means selected from anode, grid, and filament electrodes, first supply means for supplying alternating current to the filament electrodes whereby the filament-to-anode voltage and the emitted light intensity varies with time and varies across the display, second supply means for supplying voltage pulses to selected anode electrodes, third supply means for sequentially supplying pulses to respective grid electrodes, enabling means coupled to the supply means for the control electrode means for aperiodically generating control pulses to enable display illumination, pulse width modulation means for controlling the duty cycle of the control pulses thereby controlling display brightness, and means for coordinating the enabling means with the filament current to initiate successive control pulses or groups of control pulses at opposite phases of the filament current at sufficiently high rates to obtain uniform perceived display brightness.

4. A brightness control circuit for a vacuum fluorescent display having a filament and anodes comprising, means for supplying alternating current to the filament whereby the filament-to-anode voltage and the emitted light intensity varies with time and varies across the display, enabling means for aperiodically generating anode pulses for illuminating selected anodes, pulse width modulation means for controlling the duty cycle of the anode pulses thereby controlling display brightness, and means for coordinating the enabling means with the filament current to initiate successive anode pulses or groups of anode pulses for each selected anode at opposite phases of the filament current at sufficiently high rates to obtain uniform perceived display brightness.

5. A brightness control circuit for a vacuum fluorescent display having a filament and anodes comprising, means for supplying alternating current to the filament whereby the filament-to-anode voltage and the emitted light intensity varies with time and varies across the display and for supplying a square wave feedback signal corresponding to the filament current, enabling means for aperiodically generating anode pulses for illuminating selected anodes, pulse width modulation means for controlling the duty cycle of the anode pulses thereby controlling display brightness, and microprocessor means for coordinating the enabling means with the filament current by initiating successive individual anode pulses or anode pulse groups alternately synchronized to rising and falling edges of the feedback signal at sufficiently high rates to obtain uniform perceived display brightness.

6. A brightness control circuit for a vacuum fluorescent display having a filament, grids and anodes comprising, means for supplying alternating current to the filament whereby the filament-to-anode voltage and the emitted light intensity varies with time and varies across the display, multiplexing means for successively supplying grid pulses to the grids, enabling means for aperiodically generating anode pulses during grid pulse periods for illuminating selected anodes, pulse width modulation means for controlling the duty cycle of the anode pulses thereby controlling display brightness, and means for coordinating the enabling means with the filament current to initiate successive anode pulses or groups of anode pulses for each selected anode at opposite phases of the filament current at sufficiently high rates to obtain uniform perceived display brightness.

* * * * *